US007242879B2

(12) United States Patent
Kakuno et al.

(10) Patent No.: US 7,242,879 B2
(45) Date of Patent: Jul. 10, 2007

(54) IMAGE FORMING APPARATUS AND CONTROL METHOD FOR IMAGE FORMING APPARATUS

(75) Inventors: Norishige Kakuno, Nagano-ken (JP); Hideaki Inukai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 8 days.

(21) Appl. No.: 11/089,014

(22) Filed: Mar. 25, 2005

(65) Prior Publication Data

US 2006/0120736 A1 Jun. 8, 2006

(30) Foreign Application Priority Data

Mar. 26, 2004 (JP) ..... 2004-091199
Jun. 21, 2004 (JP) ..... 2004-182961
Jun. 21, 2004 (JP) ..... 2004-182972

(51) Int. Cl.
*G03G 15/08* (2006.01)

(52) U.S. Cl. ..... 399/27; 399/227

(58) Field of Classification Search ..... 399/27, 399/227, 258

See application file for complete search history.

(56) References Cited

U.S. PATENT DOCUMENTS

2004/0052538 A1* 3/2004 Yugeta et al. ..... 399/27

FOREIGN PATENT DOCUMENTS

JP 2002-351190 A 12/2002
JP 2003-316106 A 11/2003

* cited by examiner

*Primary Examiner*—David M. Gray
*Assistant Examiner*—Erika J. Villaluna
(74) *Attorney, Agent, or Firm*—Sughrue Mion, PLLC

(57) ABSTRACT

When a plurality of development units holding toner of the same color are mounted in an image formation device, an error or warning or the like is displayed on the image formation device or the error or warning is outputted to a host on the basis of the total amount of toner remaining in the plurality of development units. In addition, printing is executed continuously even when a certain toner has run out or is about to run out. An image formation device in which a plurality of development units holding toner of the same color can be mounted is characterized in that the remaining amount of all the toner of the development units holding toner of the same color is managed.

4 Claims, 13 Drawing Sheets

IMAGE FORMING APPARATUS AND CONTROL METHOD FOR IMAGE FORMING APPARATUS

BACKGROUND OF THE INVENTION

1. Field of the Invention

The present invention relates to an image forming apparatus such as a printer and a control method for the image forming apparatus. More particularly, the present invention relates to an image forming apparatus that makes it possible to select a mode relating to issuing a warning or error warning when the toner cartridge is empty and so forth, and to a control method for the image forming apparatus.

2. Description of the Related Art

Conventionally, an image forming apparatus using an electronic photocopying technology forms a color image by means of development units of four colors C (cyan), M (magenta), Y (yellow), and K (black). When this image forming apparatus uses toner of the same colors in large amounts, the time taken for the toner of the color used to run out is short in comparison with the toner of the other colors and it is accordingly necessary to perform a large number of toner exchange operations.

For this reason, a plurality of development units of the same color are provided in an attempt to alleviate the work involved in changing the development units to enable a large amount of development with toner of this color (Japanese Patent Application Laid Open No. 2002-351190, for example). Further, alleviation of the exchange work is achieved by loading developer of the same color in all four development units and using the next development unit when there is very little developer in the first development unit (Japanese Patent Application Laid Open No. 2003-316106, particularly [0063] to [0077], for example).

Meanwhile, conventionally, a color printer with development units of four colors issues a warning when the toner of each color is about to run out and performs processing and so forth to warn of an error when the toner runs out. The printing operation has conventionally been continued following the warning processing.

However, there are also cases of image forming apparatuses in which a plurality of development units holding toner of the same color are mounted where printing is executed continuously even when the toner has run out or when the toner is about to run out. This is because it is possible to perform printing continuously if a development unit in which a certain toner has not run out is used even when another toner has run out.

Moreover, in the case of this image forming apparatus, it is convenient to first warn of an error or warning when all the toner has run out or is about to run out instead of issuing a warning or error also when the toner of one development unit has run out or is about to run out.

SUMMARY OF THE INVENTION

Therefore, an object of the present invention is such that, when a plurality of development units holding toner of the same color are mounted in the image forming apparatus, an error or warning is displayed on the image forming apparatus or on a host on the basis of the total amount of toner remaining in a plurality of development units.

Further, a further object of the present invention is to execute printing continuously even when a certain toner runs out or is about to run out.

In order to achieve the above object, the present invention is an image forming apparatus in which a plurality of development units holding toner of the same color can be mounted, wherein the remaining amount of all the toner of the development units holding toner of the same color is managed. As a result, the management of the development units can be performed easily, for example.

In order to achieve the above object, the present invention is an image forming apparatus in which a plurality of development units holding toner of the same color can be mounted, comprising: control means for rendering an error display or error output when the toner of all the development units has run out. As a result, if there is an error display, for example, all the development units holding toner of the same color can be exchanged and management of the development units can be performed easily.

Further, the present invention is characterized in that, in the image forming apparatus, the control means execute a warning display or warning output when the toner of any development unit among the development units is about to run out. As a result, for example, the period for exchanging any development unit can be confirmed from a warning display and management thereof can be performed easily. Further, printing can be performed continuously by using another development unit.

In addition, the present invention is characterized in that, in the image forming apparatus, the control means execute a warning display or warning output when the toner of all the development units holding toner of the same color among the development units is about to run out. As a result, the period for exchanging all the development units can be confirmed and management can be performed easily and management thereof can be performed easily.

Furthermore, in order to achieve the above object, the present invention is a control method for an image forming apparatus in which a plurality of development units holding toner of the same color can be mounted, comprising the steps of: managing the remaining amount of all the toner of the development units holding toner of the same color. As a result, for example, management of the development units can be performed easily.

In addition, in order to achieve the above object, the present invention is a control method for an image forming apparatus in which a plurality of development units holding toner of the same color can be mounted, comprising the steps of: rendering an error display or error output when the toner of all the development units has run out. As a result, if there is an error display, for example, all the development units holding toner of the same color can be exchanged and management of the development units can be performed easily.

DESCRIPTION OF THE PREFERRED EMBODIMENTS

Overall Operation

Figure 1:
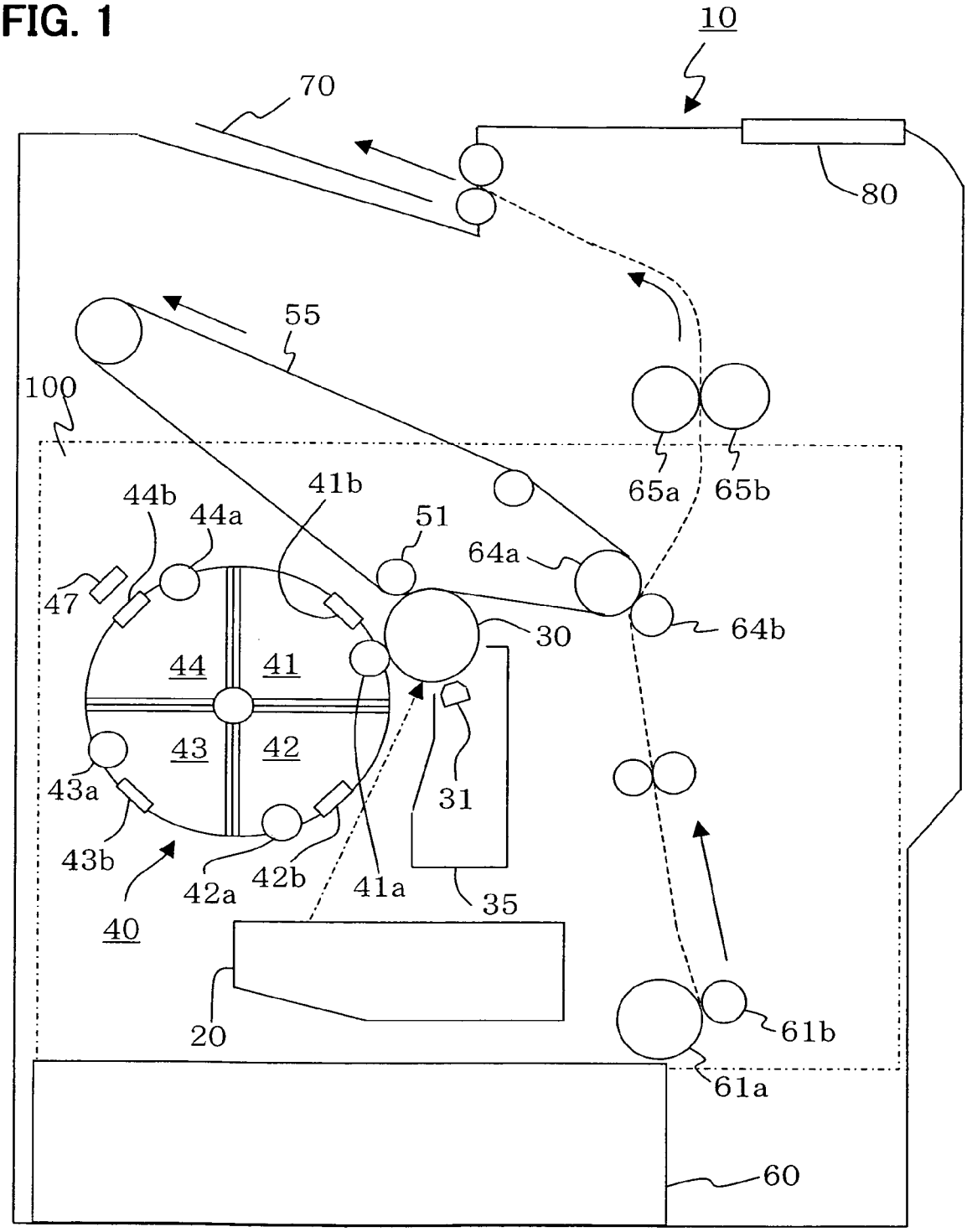
FIG. 1 is an outside constitutional view of a printer 10 used by the present invention.

Preferred embodiments for the present invention will be described while making suitable reference to the drawings. FIG. 1 is an outside constitutional view of a case where the image forming apparatus is a laser printer ('printer' hereinbelow) 10. FIG. 1 is a front view of the printer 10 in which the right-hand side of the printer 10 is on the right-hand side of FIG. 1 and the left-hand side of the printer 10 is on the left-hand side of FIG. 1.

As shown in FIG. 1, the printer 10 is substantially constituted overall by an exposure unit 20, a light-sensitive drum 30, a development device 40, a primary transfer unit 51, an intermediate transfer body 55, a cleaning unit 35, a secondary transfer units 64*a* and 64*b*, a fixing units 65*a* and 65*b*, an operation panel 80, and a control unit 100.

As shown in FIG. 1, the exposure unit 20 is located below the light-sensitive drum 30 and a laser is irradiated on the light-sensitive drum 30 on the basis of pulse data outputted by the control unit 100.

The light-sensitive drum 30 is provided in the printer 10 so as to be capable of rotation about a center axis. An electrostatic latent image is formed on the surface of the light-sensitive drum 30 as a result of the light-sensitive drum 30 being electrified by an electrification unit 31 located below the light-sensitive drum 30 and a laser from the exposure unit 20 being irradiated onto the electrified light-sensitive drum 30. As a result, the light-sensitive drum 30 supports a latent image.

The development device 40 is constituted with a plurality of detachable development units (toner cartridges) 41, 42, 43, and 44. A plurality of toner cartridges 41, 42, 43, and 44 that hold developers (toners) of the same color can be mounted in the printer 10. For example, a plurality of the toner cartridges 41, 42, 43, and 44 that hold black toner can be mounted. In this case, the printer 10 functions as a so-called single-color printer. In addition, a plurality of cartridges 41, 42, 43, and 44 that hold a plurality of colors rather than all being the same color. An example is a case in which a plurality of the same color toner is combined with toner of other colors such as C (cyan), M (magenta), K (black), and K (black). In addition, not toner need be mounted in addition to the plurality of the same color toner. For example, such cases include a case where two K toners are held when four can be held and no other cartridges are mounted, and so forth.

Further, in the case of the present invention, each of the toner cartridges 41, 42, 43, and 44 comprise, in addition to development rollers 41*a*, 42*a*, 43*a*, and 44*a* for supplying developer to the drum 30, development unit memories (cartridge memory, so-called IC tags) 41*b*, 42*b*, 43*b*, and 44*b*. Identification information and so forth on the toner cartridges 41, 42, 43, and 44 themselves is written and read contactlessly by means of a reader/writer (R/W) 47 that is provided above and to the left of the development device 40.

The primary transfer unit 51 is located above the light-sensitive drum 30 and the toner image on the light-sensitive drum 30 developed by the development device 40 is transferred to the intermediate transfer body 55. The intermediate transfer body 55 is rotationally driven at substantially the same peripheral velocity (in the direction of the arrow in FIG. 1) as the light-sensitive drum 30.

The secondary transfer units 64*a* and 64*b* serve to transfer the toner image formed on the intermediate transfer body 55 to a recordable medium 70 such as a paper, film or cloth. Further, the secondary transfer units 64*a* and 64*b* also fulfill the role of a roller for propagating upward the recordable medium 70 that has been propagated from below.

The fixing units 65*a* and 65*b* is located above the secondary transfer units 64*a* and 64*b* and render a permanent image by heat-sealing the toner image that has been transferred to the recordable medium 70 on the recordable medium 70.

The cleaning unit 35 is provided between the primary transfer unit 51 and electrification unit 31 and is able to scrape off toner remaining on the light-sensitive drum 30 by means of a rubber cleaning blade.

In addition, the printer 10 comprises, as shown in FIG. 1, a paper supply tray 60 in which a plurality of recordable media 70 are housed and a plurality of roller pairs 61*a* and 61*b* and so forth. The recordable media 70 such as printed papers are propagated by the paper supply tray 60 and the printed medium 70 is ejected from the exit opening.

An operating panel 80 that permits a variety of print directions and print media is provided at the top of the printer 10 and fulfills the role of the user interface.

Figure 2:
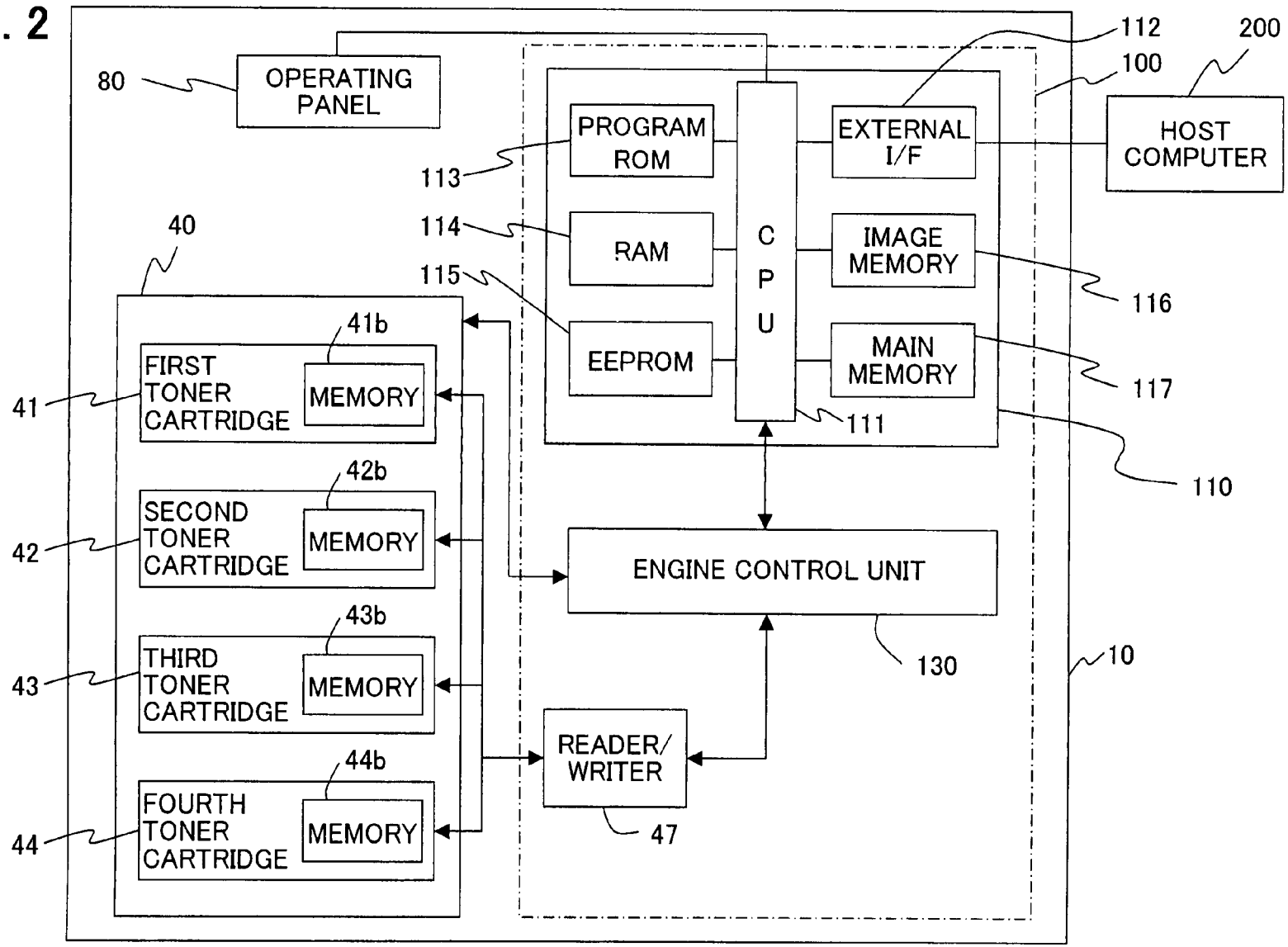
FIG. 2 shows the constitution of the printer 10.

Thereafter, the whole of the constitution of the printer 10 containing the control unit 100 will be described using FIG. 2. FIG. 2 shows the development device 40, the operating panel 80, and the control unit 100 that constitute the printer 10. In addition, the printer 10 is connected to the host computer 200.

First, the control unit 100 (shown by a single dot chain line in FIG. 2) will be described. The control unit 100 is constituted overall by a main control unit 110, an engine control unit 130, and a reader/writer 47. As shown in FIG. 2, the main control unit 110 is constituted by a CPU 111, an external interface (I/F) 112, a program ROM (Read Only Memory) 113, a RAM (Random Access Memory) 114, an EEPROM (Electronically Erasable and Programmable Read Only Memory) 115, an image memory 116, and a main memory 117.

The CPU 111 is mutually connected to an external I/F 112, a program ROM 113, a RAM 114, an EEPROM 115, an image memory 116, and the main memory 117. The CPU 111 performs error processing of the present invention when the toner has run out and performs warning processing when the toner is about to run out, and so forth, by suitably executing various programs that are stored in the program ROM 113. Further, the CPU 111 is also connected to the operating panel 80 and performs display control and so forth on the operating panel 80.

The external I/F 112 is also connected to the host computer 200. Print job data for printing from the host computer 200 is inputted and converted to data that can be processed in the printer 10.

The program ROM 113 stores a variety of programs for executing processing by means of the CPU 111. The RAM 114 stores a variety of flag data (described subsequently) and data that has been processed by the CPU 111.

The EEPROM 115 is a nonvolatile memory that stores model information on the printer 10 and values relating to the toner remaining amount warning mode (described subsequently). The image memory 116 is a memory that stores image data that is inputted to the external I/F 112. This memory 117 stores information and so forth that is stored in cartridge memories 41*b*, 42*b*, 43*b*, and 44*b*.

The engine control unit 130 will be described next. As shown in FIG. 2, the engine control unit 130 is connected to the CPU 111 of the main control unit 110, the development device 40, and the reader/writer 47. The engine control unit 130 mainly controls the drive of the engine part of the printer 10 and rotationally drives the development device 40 on the basis of the command of the CPU 111 of the main control unit, for example. Further, the engine control unit 130 is also connected to the reader/writer 47. The reader/writer 47 performs control to write and read data to and from the respective cartridge memories 41*b*, 42*b*, 43*b*, and 44*b*.

Overall Processing Including Warning Processing and Error Processing

Figure 3:
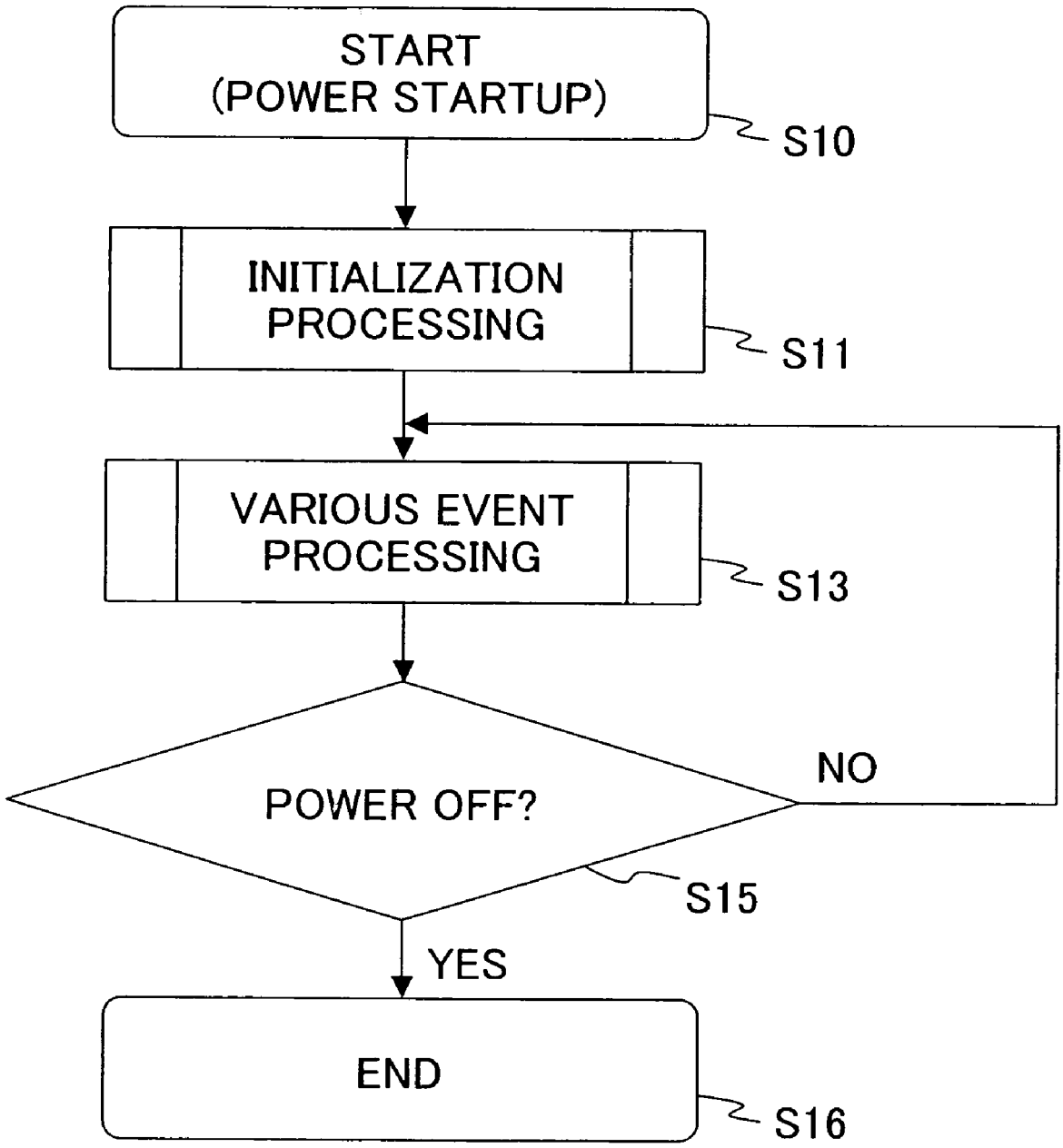
FIG. 3 is a flowchart showing the operation of all the processing of the printer 10.

The details of the overall processing for the printer 10 constituted as described above will be described hereinbelow. FIG. 3 is a flowchart showing the operation of the overall processing First, when the power supply of the printer 10 is started up, the CPU 111 of the main control unit 110 reads a program for executing this processing from the program ROM 113 and commences processing (step S10). Thereafter, the CPU 111 performs initialization processing (step S11). This serves to perform initialization on the engine side of the roller 61*a* and perform confirmation of the development units 41, 42, 43, and 44 that are mounted in the development device 40 and confirmation of the warning display mode and so forth.

Figure 4:
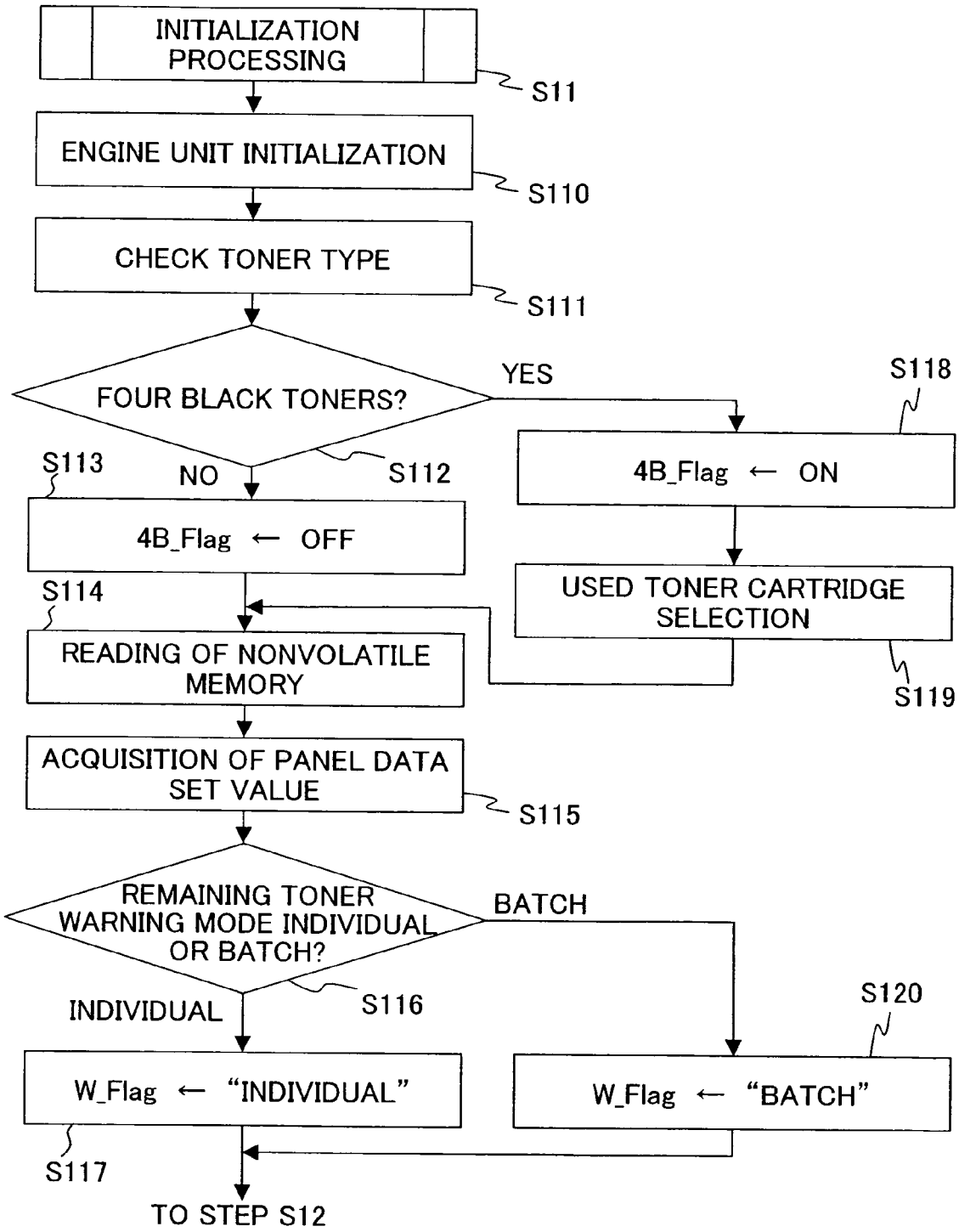
FIG. 4 is a flowchart showing an initialization processing operation.

The details of the initialization processing (step S11) are shown in FIG. 4. When the transition to initialization processing is made, the CPU 111 first performs initialization processing of the engine portion (step S110).

Thereafter, a CPU111 performs a check of the toner type (step S111). That is, processing to read color information that is stored in the cartridge memories 41*b*, 42*b*, 43*b*, and 44*b* is performed. For example, information relating to the color (black, cyan, and so forth) of the toner that is held in the cartridge memories 41*b*, 42*b*, 43*b*, and 44*b* when each of the toner cartridges 41, 42, 43, and 44 are shipped from the factory is written. This is read in this step.

Thereafter, the CPU 111 judges whether all four of the mounted toner cartridges 41, 42, 43, and 44 have black toner (step S112). Judgment is made by a color information acquired by step S111. Further, the judgment judges whether the toner cartridges 41, 42, 43, and 44 mounted in the development device 40 have the same color, which is not limited to only black. For example, all the toner cartridges may be cyan or all may be magenta, and so forth. In addition, the number of development units is not limited to four and may instead be three, two, five, and six, and so forth. Also, although four K toners are described in this embodiment, there are also cases with another plurality of K toners. For example, cases include CMKK cases with K toners mounted and cases where four can be mounted but, of those four, two K toners are mounted and no other toners are mounted, and so forth. That is, it is judged in this step whether a plurality of toners of the same color are mounted.

When four black toners are mounted ("YES" in step S112), the CPU 111 then sets the value of 4B_Flag to ON (step S118). The 4B_Flag is a flag indicating whether there are four K toners that is used in warning processing and error processing (described subsequently). This flag may indicate whether a plurality of toners of the same color are mounted.

Thereafter, the CPU 111 selects the use toner cartridges 41, 42, 43, and 44 (step S119). That is, when a plurality of cartridges of the same color is mounted, the CPU 111 selects a method with regard to how to use the cartridges. For example, a cartridge is used because the toner capacity is small or is used because of an old date of fabrication, and so forth. This information is stored in the main memory 117 or RAM 114, or the like, for example, and is selected as a result of being read by the CPU 111.

On the other hand, when there are four mounted toner cartridges 41, 42, 43, and 44 and there is no black toner ("NO" in step S112), the CPU 111 sets the abovementioned 4B_Flag to OFF ("0", for example) (step S113). For example, when toner cartridges 41, 42, 43, and 44 of four colors C, M, Y, and K are mounted in the development device 40, "NO" is selected in this step. OFF may be set in cases where a plurality of toners of the same color are not mounted.

Supposing that 4B_Flag is OFF (step S113) and the used toner cartridge has been selected (step S119), the CPU 111 then performs read processing by accessing the nonvolatile memory (step S114). That is, the CPU 111 accesses the EEPROM 115.

Thereafter, the CPU 111 acquires the panel data set value (step S115). The CPU 111 acquires the panel data set value by accessing the EEPROM 115 as a result of step S114 and reading the panel data set value held in EEPROM 115. The panel data set value has a variety of values set by the operating panel 80 and is suitably held in the EEPROM 115 by the CPU111.

Thereafter, the CPU111 judges whether, among the acquired panel data set values, remaining toner warning modes are set individually set or set batchwise (step S116). The operating panel 80 makes it possible to establish in which mode to display a warning for the remaining toner amount and makes it possible to select whether to implement an individual display for each of the mounted toner cartridges 41, 42, 43, and 44 or to display the toner cartridges 41, 42, 43, and 44 batchwise as one. This data is included in the panel data set values and the CPU 111 judges whether the mode is an individual or batch mode in this step. Further, a mode can also be set by the host 200 in addition to the mode being selected by the operating panel 80. In this case, the data on whether the selected mode is an individual or batch mode is inputted by the host 200 and stored in the EEPROM 115, and may be read in this step.

When the remaining toner warning mode is set individually ("individual" in step S116), the CPU 111 sets the W_Flag to "individual" (step S117). For example, there is a W-Flag storage region in a predetermined region of the EEPROM 115 and "individual" ("0", for example), which is the value of the W_Flag is stored by the CPU 111. The W-Flag is a flag that indicates the selected mode and is used in the warning processing or error processing (described subsequently). Further, a case where, when the modes are set individually, cartridges 41, 42, 43, and 44 of the same color are mounted in the printer 10 and users are allocated to the respective cartridges 41, 42, 43, and 44 may be considered.

On the other hand, when the remaining toner warning mode is a batch mode ("batch" in step S116), the CPU 111 sets the W-Flag to "batch" ("1", for example) (step S120). When storage to W_Flag is terminated (when steps S117 and S120 are complete), a series of initialization processes are also terminated and the transition is made to various event processes (step S13) after returning to FIG. 3. Further, the CPU 111 displays the current mode on the operating panel 80 by reading the W_Flag stored in the EEPROM 115 and is able to notify the host computer 200 via the external I/F 112.

Figure 5:
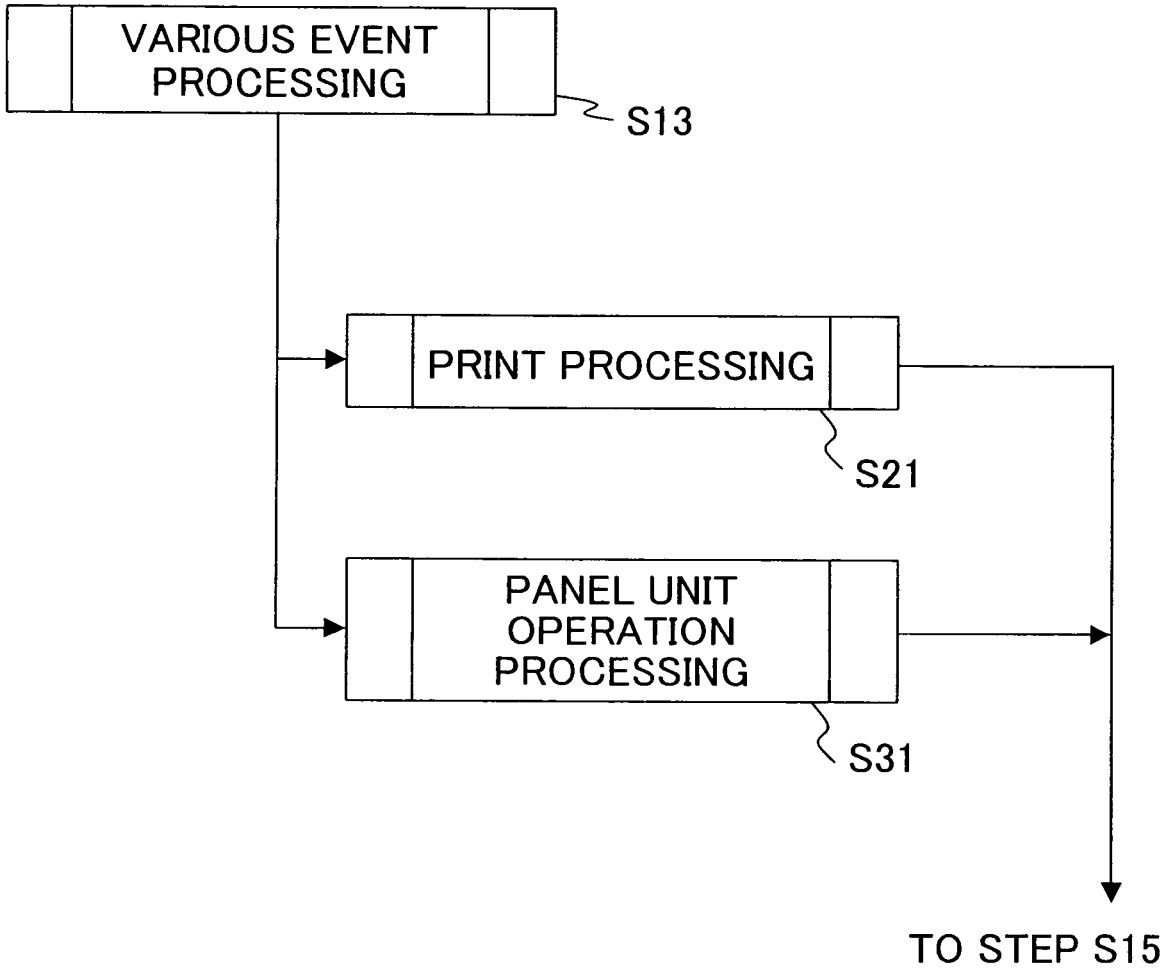
FIG. 5 is a flowchart showing the operation of various event processing.

The details of the various event processes (step S13) are shown in FIG. 5. As shown in FIG. 5, the event processing of this embodiment consists of print processing (step S21) and panel operation processing (step S31). In reality, in addition, when the door of the printer 10 body is opened, warning processing that issues a warning display and so forth is performed. However, such processing is omitted here to simplify the description.

Figure 6:
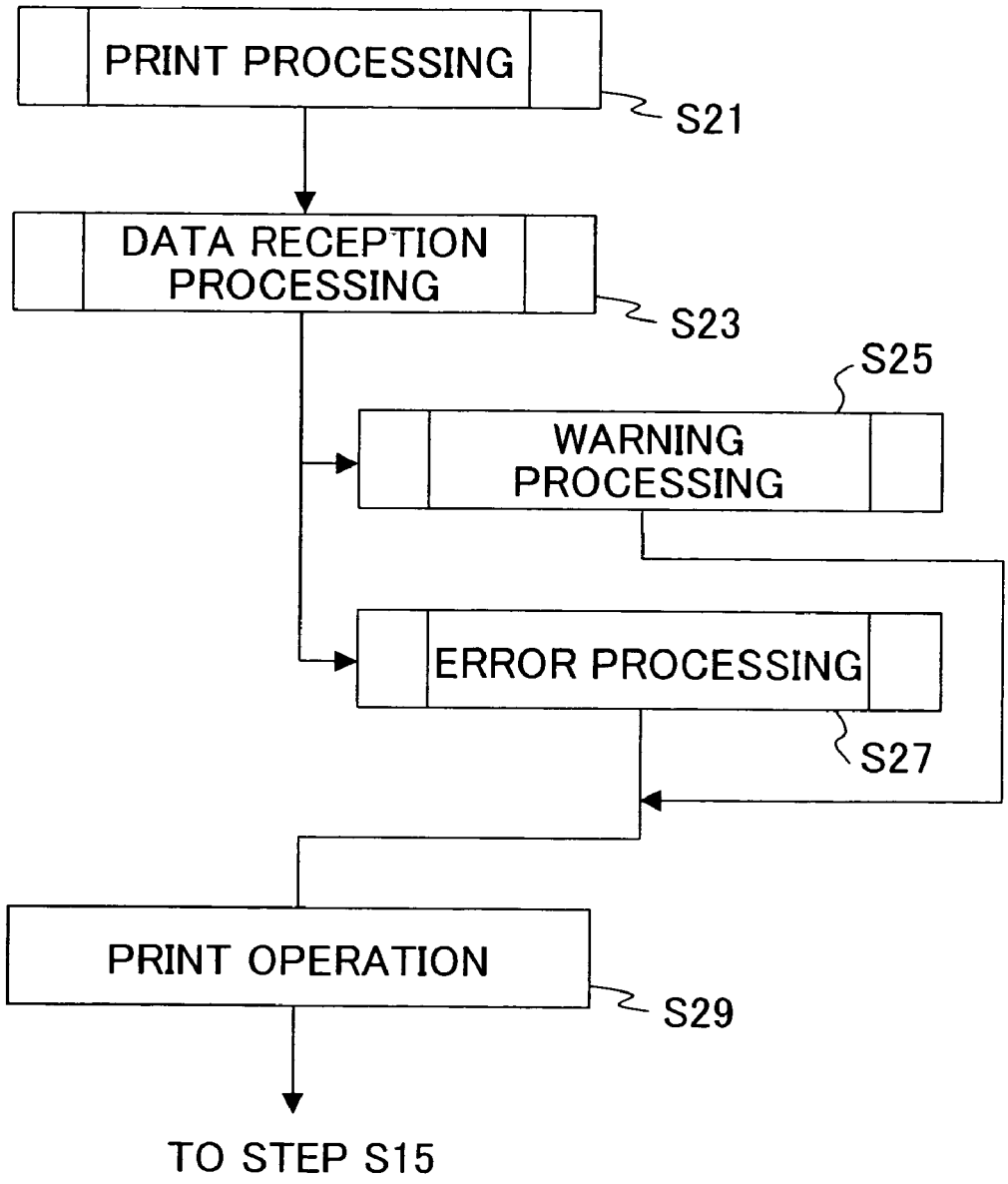
FIG. 6 is a flowchart showing the operation of print processing.
Figure 7:
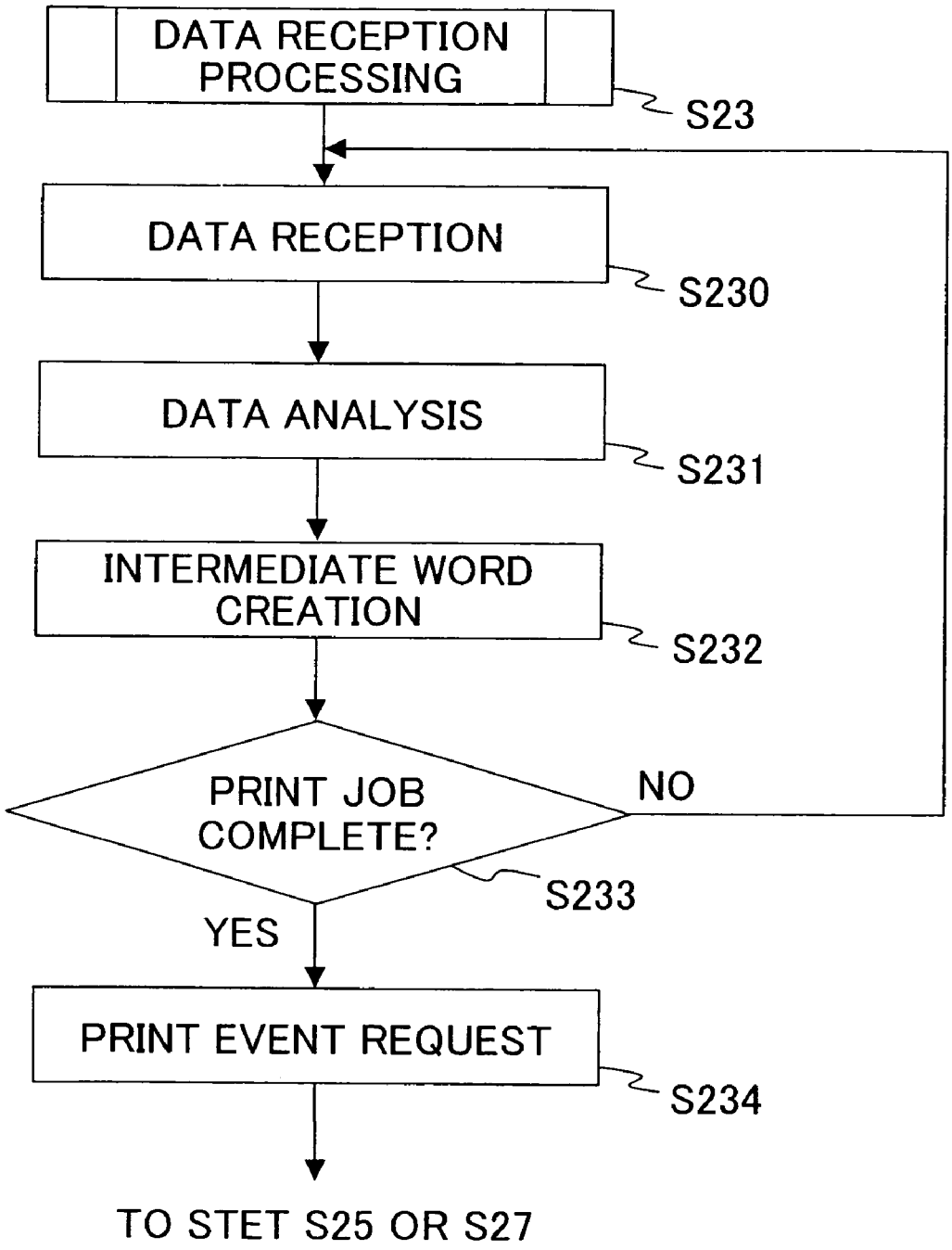
FIG. 7 is a flowchart showing the operation of data reception processing.

The details of the print processing (step S21) in the event processing (step S13) are shown in FIG. 6. When print processing is executed, the CPU 111 first performs data reception processing (step S23). The details of the data reception processing are shown in FIG. 7. Upon shifting to the data reception processing, the CPU 111 first receives print job data from the host 200 (step S230). The CPU 111 temporarily stores print job data, which has been inputted via the external I/F 112, in the RAM 114.

Thereafter, the CPU 111 performs a data analysis (step S231). That is, the CPU 111 generates instruction information on the print position and line width and so forth of the print data (text data, graphic data and image data, and so forth) from information such as commands contained in the print job data.

Thereafter, the CPU 111 creates an intermediate language (step S232). That is, the CPU 111 creates an instruction code (intermediate code) indicating an instruction for expanding the print data in the image memory 116 by using the instruction information above and so forth. The print data stored in the RAM 114 is expanded in the image memory 116 on the basis of the intermediate code.

Thereafter, the CPU 111 judges whether the inputting of print job data is complete (step S233). If there is other print job data ("NO" in this step S233), the processing makes the transition to step S230 once again and repeats the processing. On the other hand, when the processing of the print job data is complete ("YES" in this step S233), the processing shifts to step S234.

The CPU 111 outputs a request for a print event in step S234. Print processing is actually executed by the engine control unit 130 or the like as a result of this event request. However, even when the data reception processing (step S23) ends as shown in FIG. 6 and a print event request is outputted, the actual print operation must be performed after the warning processing or error processing or the like.

That is, when the data reception processing ends as shown in FIG. 6, the warning processing and error processing relating to the amount of toner remaining and so forth are executed.

Figure 8:
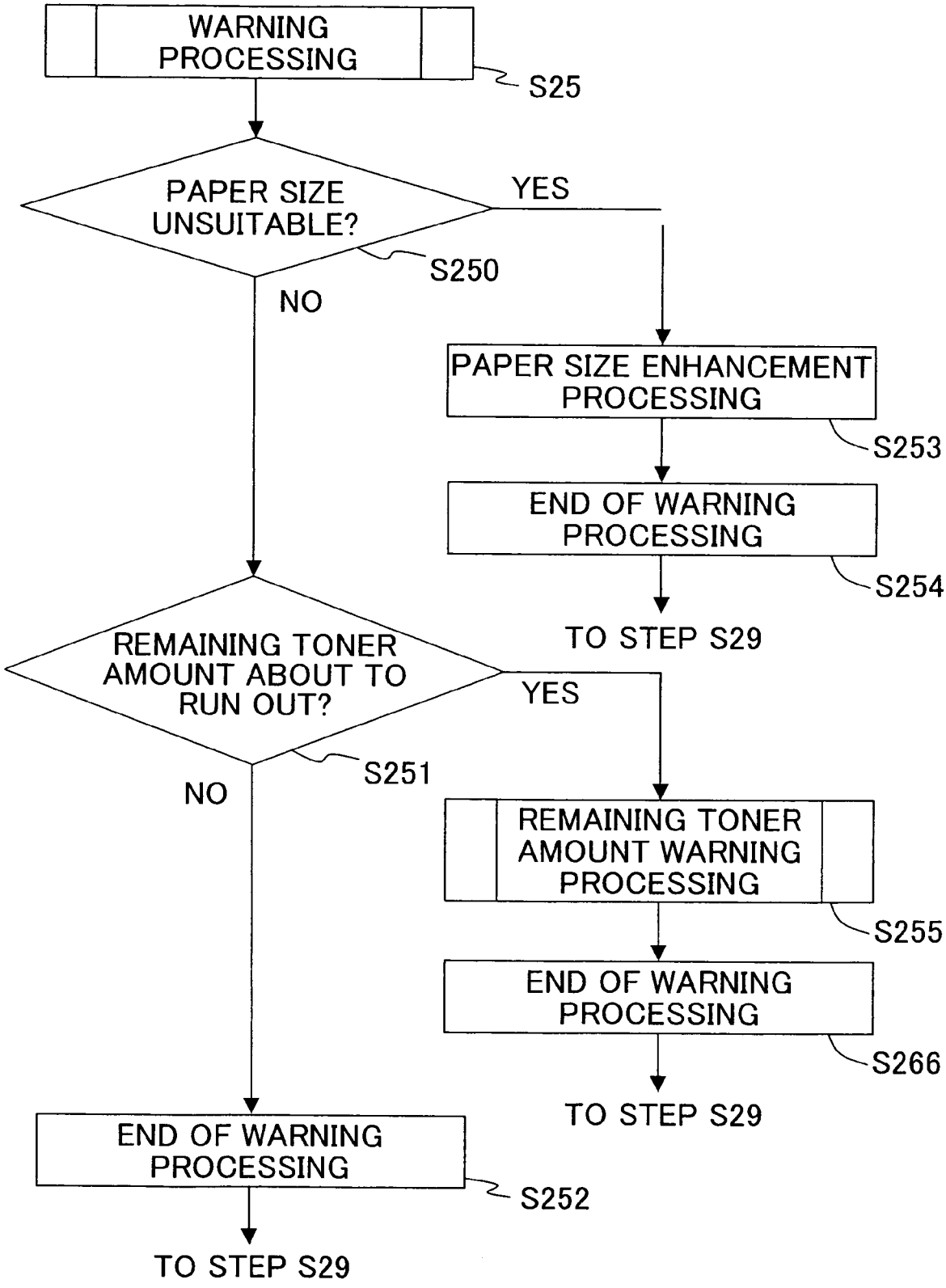
FIG. 8 is a flowchart showing the operation of warning processing.

The details of the warning processing (step S25) are shown in FIG. 8. Upon making the transition to warning processing, the CPU 111 judges whether the paper size is inappropriate or not (step S250). For example, this judgment is made when the size of the print paper is designated in the print job data or by the operating panel 80 or the like but the paper of this size is not housed in the paper supply tray 60.

When the paper size is unsuitable ("YES" in step S250), paper size enhancement processing is performed (step S253). For example, paper of the size designated by the print job data and operating panel 80 is housed in the paper supply tray 60, and so forth. Further, this warning processing (step S25) ends (step S254) and the print operation shown in FIG. 6 (step S29) is performed.

On the other hand, when the paper size is not unsuitable ("NO" in step S250), the CPU 111 judges whether the remaining toner amount is about to run out for each cartridge (step S251). For example, the amount of toner used each time toner is used is calculated by the engine control unit 130. The calculation itself also calculates, for example, the time when the toner cartridges 41, 42, 43, and 44 are located in a position opposite the light-sensitive drum 30 and the used toner amount by means of a toner counter from the number of printed sheets and so forth. Further, the remaining toner amount may be calculated by means of a sensor. It is judged from this calculation value whether the remaining toner amount is about to run out.

Figure 9:
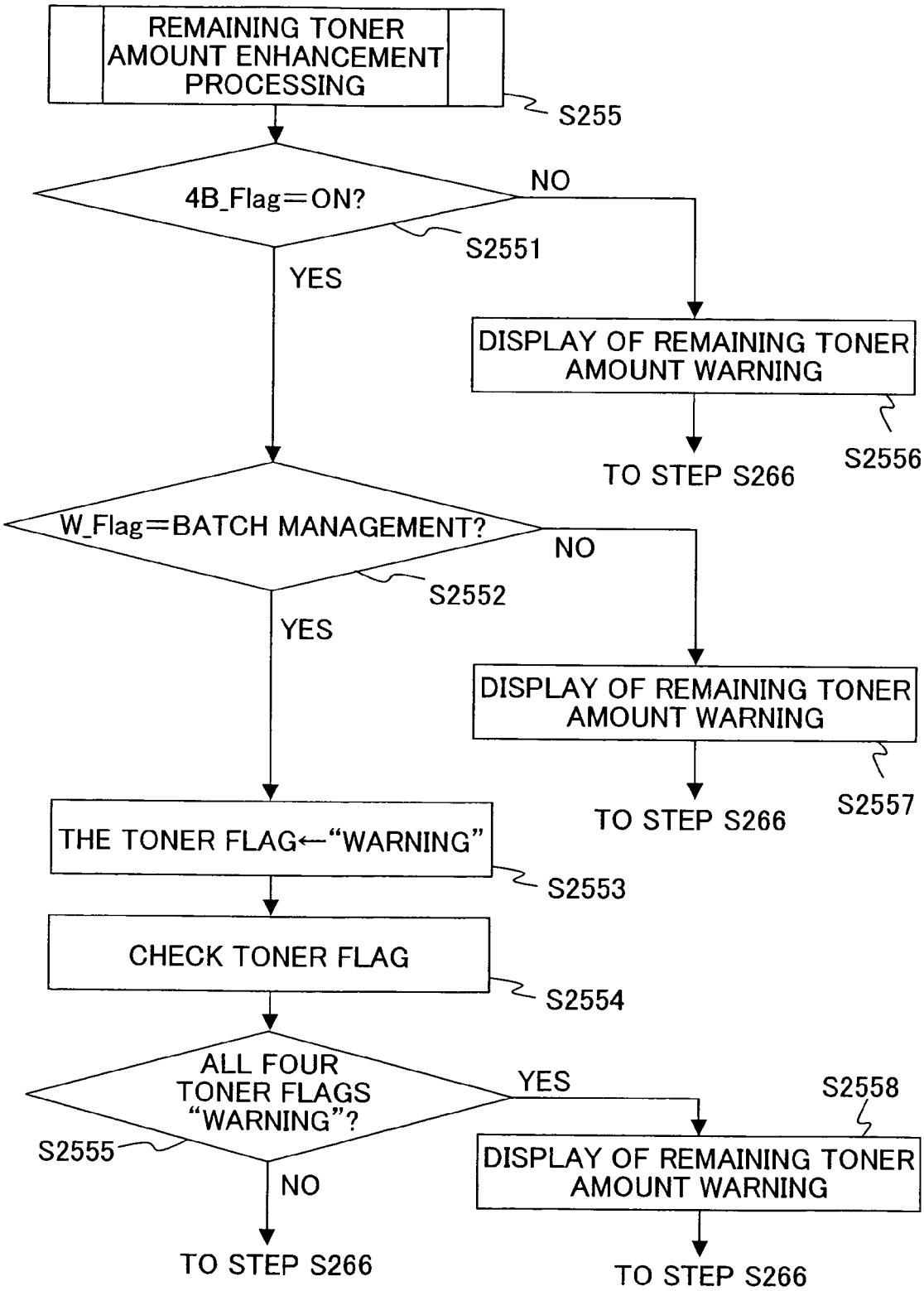
FIG. 9 is a flowchart showing the operation of the remaining toner warning processing.

When the remaining toner amount is about to run out ("YES" in step S251), the processing makes the transition to the remaining toner amount warning processing (step S255). The details of the remaining toner amount warning processing is shown in FIG. 9. When the transition is made to this processing, the CPU 111 judges whether the 4B_Flag is ON (step S2551). In the initialization processing, the 4B_Flag stored in the RAM 114 (steps S113 and S118 in FIG. 4) is read and judged. That is, it is judged whether all four of the toners of the toner cartridges 41, 42, 43, and 44 that are mounted in the development device 40 are black.

Figure 10A:
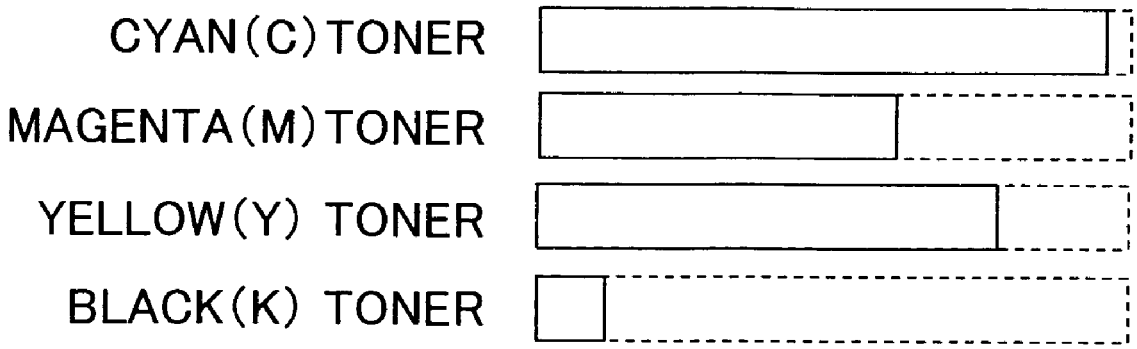
FIG. 10A shows a display example of the toner remaining amount when the respective CMYK toners are held.

When the 4B_Flag is not ON ("NO" in step S2551), the CPU 111 then implements a warning display for the remaining toner amount (step S2556). This serves to encourage the user to exchange the toner because the remaining toner amount is about to run out. For example, when K toner is about to run out in a case where C, M, Y, and K toners are held in four toner cartridges 41, 42, 43, and 44. A display example is shown in FIG. 10A. In addition, a message such as "black toner is running out" may also be displayed. The display shown in FIG. 10A is displayed on the operating panel 80 and on the monitor screen of the host computer 200 by means of the control of the CPU111.

On the other hand, when the 4B_Flag is ON ("YES" in step S2551), the CPU111 then judges whether the W_Flag is batch (step S2552). That is, the CPU111 judges whether the remaining toner warning mode is a four batch management mode or a four individual management mode. Because the W_Flag is stored in the EEPROM 115 in the initialization processing (steps S117 and S120 in FIG. 4), the CPU111 reads and judges the W_Flag.

Figure 10B:
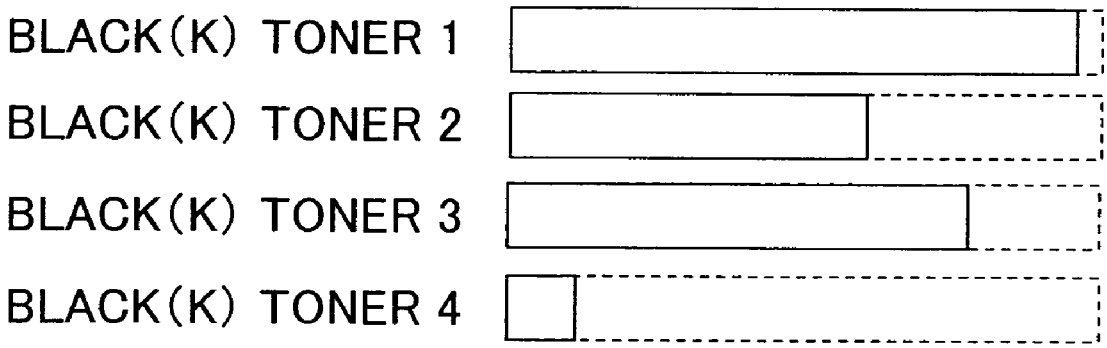
FIG. 10B shows a display example of a toner remaining amount when the K toner is held.

When the W_Flag is not batch ("NO" in step S2552), that is, in the case of the individual management mode, the CPU111 implements the remaining toner amount warning display (step S2557). In this case, although all four of the toner cartridges 41, 42, 43, and 44 hold black toners because 4B_Flag is ON, because the mode is a mode in which warnings are issued individually, the display is as shown in FIG. 10B, for example. The example shown in FIG. 10B is a state where four K toners 4 are about to run out. Similarly to FIG. 10A, the display is on the operating panel 80 or on the monitor screen of the host computer 200.

Further, numbers are displayed in the display shown in FIG. 10B, and these numbers correspond to the cartridge numbers. The cartridge numbers are numbers that are allocated in order when the respective toner cartridges 41, 42, 43, and 44 are in a predetermined position in the developer 40. For example, toner cartridge 43 is cartridge number "1" and, subsequently in order, cartridge 44 is cartridge number "2", cartridge 41 is number "3", and cartridge 42 is "4". When these cartridge numbers are allocated, in the example of FIG. 10B, the toner of the toner cartridge 43 with cartridge number "1" has barely been used and the toner of the toner cartridge 42 with cartridge number "4" is about to run out.

Returning now to the processing in FIG. 9, when a batch W_Flag has been stored (when "YES" in step S2552), that is, when the warning mode is the batch management mode, the CPU 111 then stores information relating to "warning" for the toner flag (step S2553). For example, the CPU111 stores information ("1", for example) relating to "warning" in a predetermined region of the RAM 114.

Thereafter, the CPU111 checks the toner flags stored in the RAM114 (step S2554). When batch management mode is implemented, this serves to judge whether the toner of all the cartridges 41, 42, 43, and 44 is about to run out.

Thereafter, the CPU111 judges whether all four of the checked toner flags is information relating to "warning" (step S2555). When batch management mode is implemented, this serves to judge whether all the toner is about to run out.

Figure 10C:
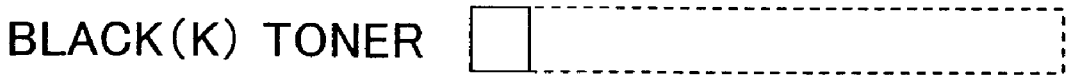
FIG. 10C shows a display example of a toner remaining example in batch mode.

When all four of the checked toner flags indicate "warning" ("YES" in step S2555), the CPU111 then performs a remaining toner amount warning display (step S2558). An example of the remaining amount display is shown in FIG. 10C. Because all four are K toners ("YES" in step S2551) and remaining toner warning mode is batch mode ("YES" in step S2552), rather than displaying all four, the display is as if one toner cartridge were mounted. The remaining toner amount warning processing ends and the transition is made to step S266 in FIG. 8.

On the other hand, when all four are not "warning" ("NO" in step S2555), this processing (step S255) ends without displaying a warning and the processing shifts to step S266 in FIG. 8. That is, when all four toners are K toners ("YES" in step S2551) and batch management mode is implemented ("NO" in step S2552), even when only one (or two or three) of the four toner cartridges 41, 42, 43, and 44 is about to run out, because this does not mean that the other toners are about to run out, processing advances and the print operation is performed without performing a warning display. As a result, it is possible to continue print processing by using the other toner cartridges 41, 42, 43, and 44 that are not about to run out without executing a warning display. Here, continued printing may be performed by indicating the fact that printing is continued on the operating panel 80 or monitor screen of the host computer 200, for example. In addition, warnings when toner is about to run out when batch management mode is implemented include a case where a warning display is executed for all the toner when one toner among a plurality of mounted toners of the same color is about to run out, and a case where a warning display is executed for all the toner when the all toner is about to run out for all the toner.

Thus, by selecting the remaining toner warning mode as batch or single, it is possible to establish a case where the warning display is not executed until the toner of all the toner cartridges is about to run out, and a case where the warning display is executed when the toner of only one toner cartridge is about to run out. In addition, as a result of this selection, it is possible to establish a case where the remaining toner amount display is performed by displaying all the toner cartridges, and a case where the remaining toner amount display is executed as one toner cartridge. Furthermore, in the case of printing when batch management mode is implemented, for example, usage can be continued until the cartridge in which toner is about to run out is empty and then printing can be continued by using the other toner cartridges 41, 42, 43, and 44 in which toner has not run out. Further, so too in individual management mode, even when there are cartridges 41, 42, 43, and 44 in which toner is about to run out, printing can also be continued until the toner of cartridges 41, 42, 43, and 44 runs out.

When remaining toner amount warning processing (step S255) ends, returning now to FIG. 8, the CPU 111 then ends the warning processing (step S25) (step S266). Further, returning now to FIG. 6, the CPU111 then actually performs a print operation (step S29).

Figure 11:
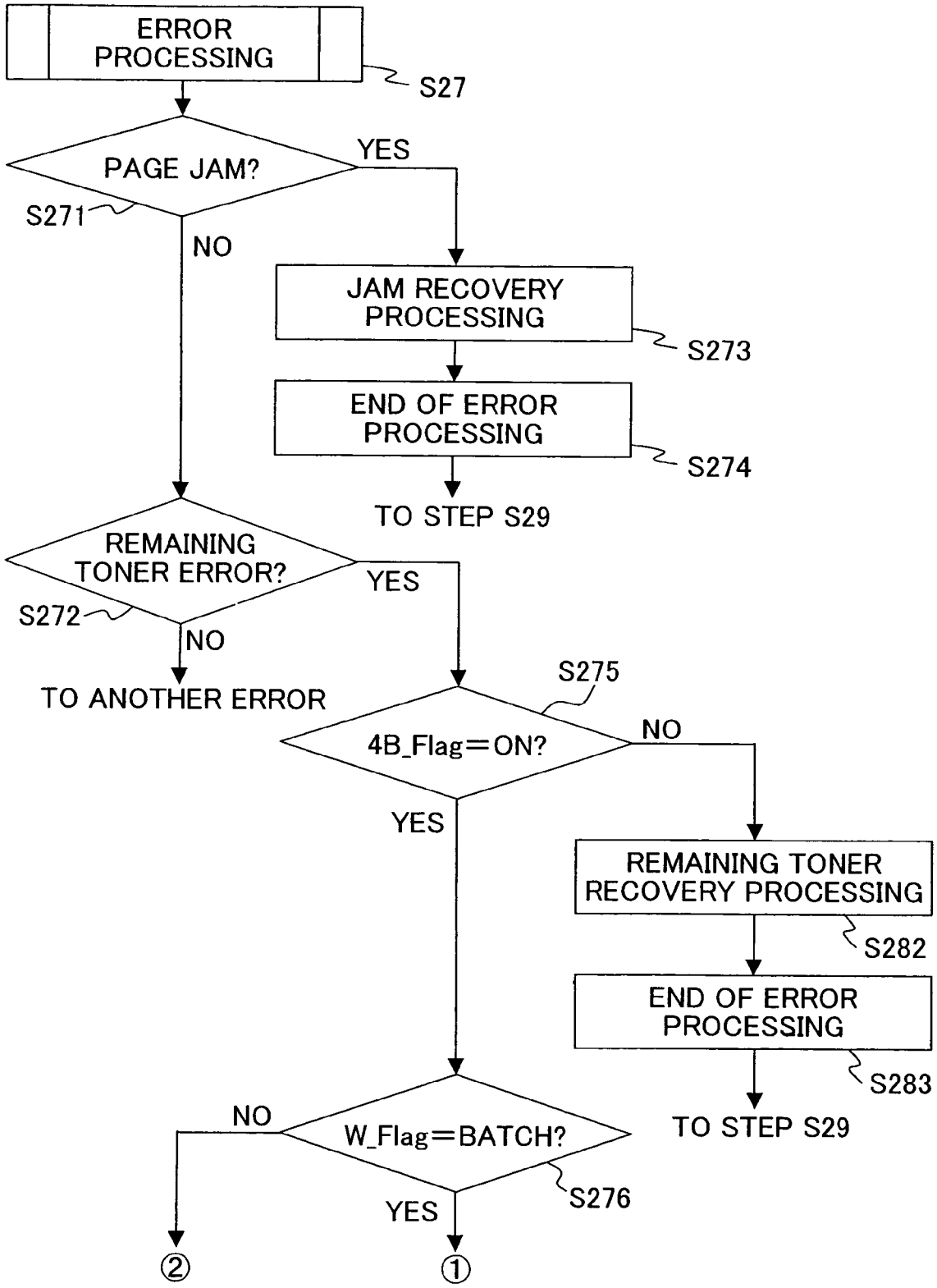
FIG. 11 is a flowchart showing the operation of the error processing.

On the other hand, when error processing (step S27) is executed after data reception processing (step S23) has ended, as shown in FIG. 6, the processing shown in FIG. 11 is executed. That is, the CPU 111 judges whether a paper jam has occurred upon shifting to error processing (step S271). For example, cases include a case where the recording medium 70 is blocked in the conveyance path.

When a paper jam occurs ("YES" in step S271), recovery processing is then performed (step S273). For example, processing is performed as a result of the user removing the cover of the printer 10, extracting the recording medium blocked in the conveyance path and closing the cover once again. Further, this error processing (step S27) ends (step S274) and the processing shifts to step S29 shown in FIG. 6.

On the other hand, when a paper jam has not occurred ("NO" in step S271), the CPU111 then judges whether a remaining toner error has occurred (step S272). That is, the CPU111 judges whether the equivalent of one toner held in the respective toner cartridges 41, 42, 43, and 44 has run out.

When a remaining toner error has not occurred ("NO" in step S272), the CPU111 then advances processing to determine whether there is an additional error. On the other hand, when a remaining toner error has occurred ("YES" in step S272), the CPU111 then judges whether the 4B_Flag is ON (step S275). That is, the CPU111 judges whether the toner cartridges 41, 42, 43, and 44 mounted in the development device 80 are all K toner. The initialization processing (see FIG. 4) judges by reading the value of the 4B_Flag stored in the RAM114.

When the 4B_Flag is not ON ("NO" in step S275), for example, when the cartridges 41, 42, 43, and 44 that hold toners in the colors C, M, M, and K are mounted in the development device 40, the CPU111 then perform an error display and performs remaining toner recovery processing (step S282). This is because, if there is one cartridge 41, 42, 43, or 44 in which toner has run out among the toner cartridges 41, 42, 43, and 44 that hold color toner, the printing operation cannot be performed subsequently. Therefore, a new toner cartridge 41, 42, 43, or 44 housing toner is mounted in the development device 40. The error display is displayed as "there is no K toner", for example. Error processing then ends (step S283) and the processing shifts to step S29 in FIG. 6.

On the other hand, when the 4B_Flag is ON ("YES" in step S275), the CPU111 then judges whether the W_Flag indicates batch management (step S276). The CPU111 judges that all four cartridges are K-toner cartridges 41, 42, 43, and 44 and whether four cartridges 41, 42, 43, and 44 are individually managed or managed batchwise.

Figure 12:
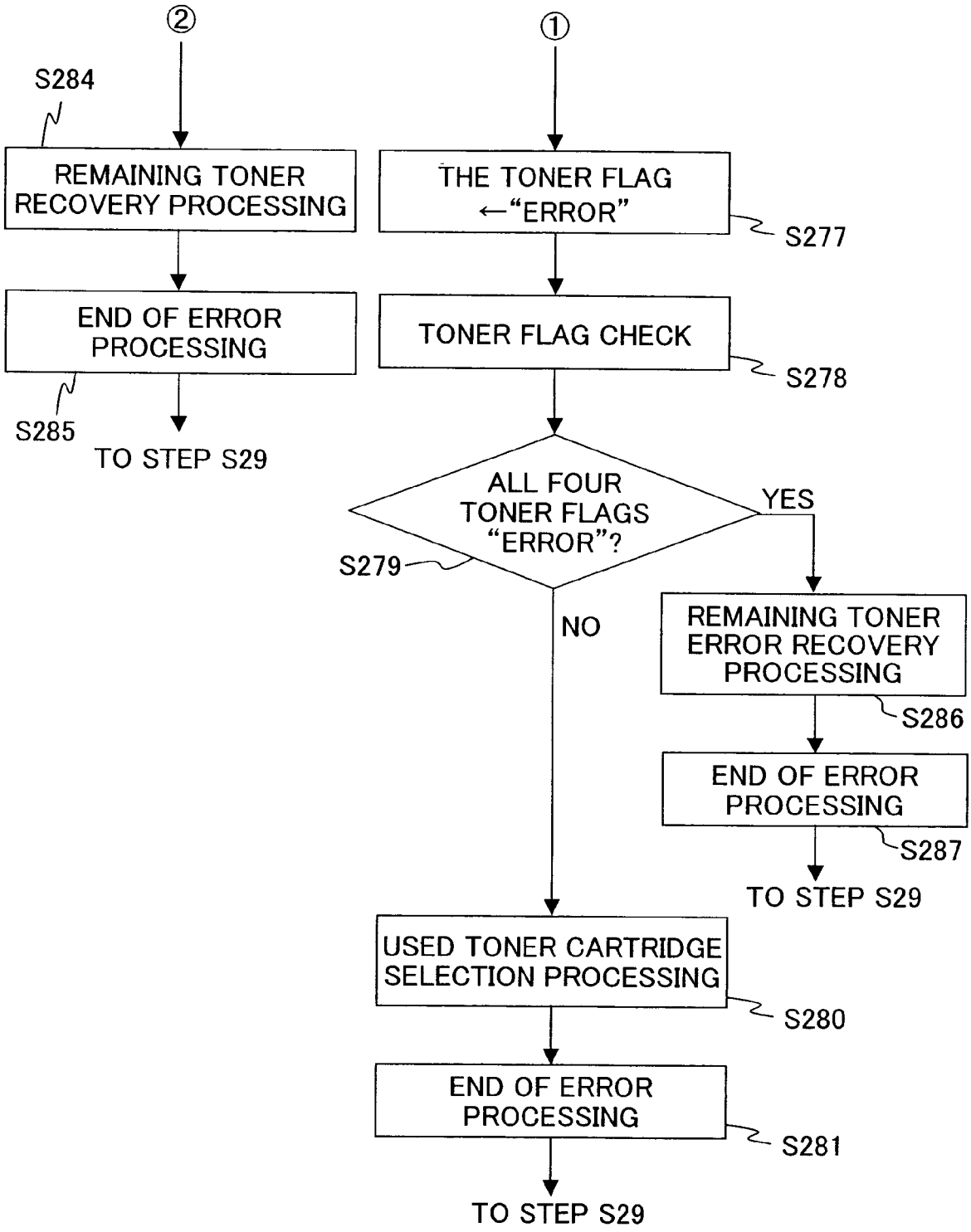
FIG. 12 is a flowchart showing the operation of the error processing.

When the W-Flag does not indicate batch management ("NO" in step S276), the CPU111 then shifts to step S284 in FIG. 12 and performs remaining toner recovery processing (step S284). That is, when a mode in which four cartridges have K toner but the toner cartridges 41, 42, 43, and 44 are managed individually is implemented, an error display is performed when one toner has run out and the mounting of a cartridge 41, 42, 43, or 44 holding toner is awaited. When a toner cartridge 41, 42, 43 or 44 is newly mounted, the CPU111 ends the error processing (step S285) and shifts to step S29 in FIG. 6.

On the other hand, when the W_Flag indicates batch management ("YES" in step S276), the CPU111 then stores a value indicating "error" for the toner flag (step S277). For example, a value ("1" or the like, for example) indicating an error is stored in a predetermined region of the RAM114 or EEPROM 115.

The CPU111 then retrieves a toner flag of the RAM114 or the like (step S278) and judges whether the toner flags of all the toner cartridges 41, 42, 43, and 44 indicate an "error" (step S279). That is, it is judged whether the toners of all the toner cartridges 41, 42, 43, 44 have run out.

When all the toner flags indicate an error ("YES" in step S279), management is in batch mode and all toner has run out and, in order to perform the subsequent print operation, an error display is executed and recovery processing is performed (step S286). The error display is "no toner", which is displayed on the operating panel 80 and on the monitor of the host computer 200. The recovery processing is performed by mounting cartridges 41, 42, 43, and 44 all four of which hold K toner, for example. When all the cartridges are mounted, the CPU111 ends the error processing (step S287) and the processing shifts to step S29 in FIG. 6.

On the other hand, when none of the four indicates an error ("NO" in step S279), the CPU111 performs selection processing for the used toner cartridges 41, 42, 43, and 44 without executing an error display or performing recovery processing (step S280). Even when there is a cartridge in which toner has run out, when batch management mode is implemented, an error display or the like is not executed unless the toner of all the cartridges 41, 42, 43, and 44 has runout. This is because, as when error remaining warning processing is implemented, the other toner cartridges 41, 42, 43, and 44 in which toner has not run out are used to perform a print operation continuously. Further, a batch management mode and individual management mode can be pre-selected (set with initial settings) and the processing when toner has actually run out is changed accordingly. The cartridge selection processing in this step is not an error, that is, another toner cartridge in which toner has not run out is selected.

This error processing then ends (step S281) and the processing shifts to step S29 in FIG. 6. In step S29, the print operation is performed. That is, as mentioned earlier, the pulse data generated by the data reception processing is outputted to the CPU131 of the engine control unit 130 and print data that is created by the application 210 is formed on the recordable medium 70 as a result of a laser being irradiated thereon by the exposure unit 20 and so forth. Thereafter, the print processing event ends (see FIG. 5) and shifts to step S15 in FIG. 3.

Figure 13:
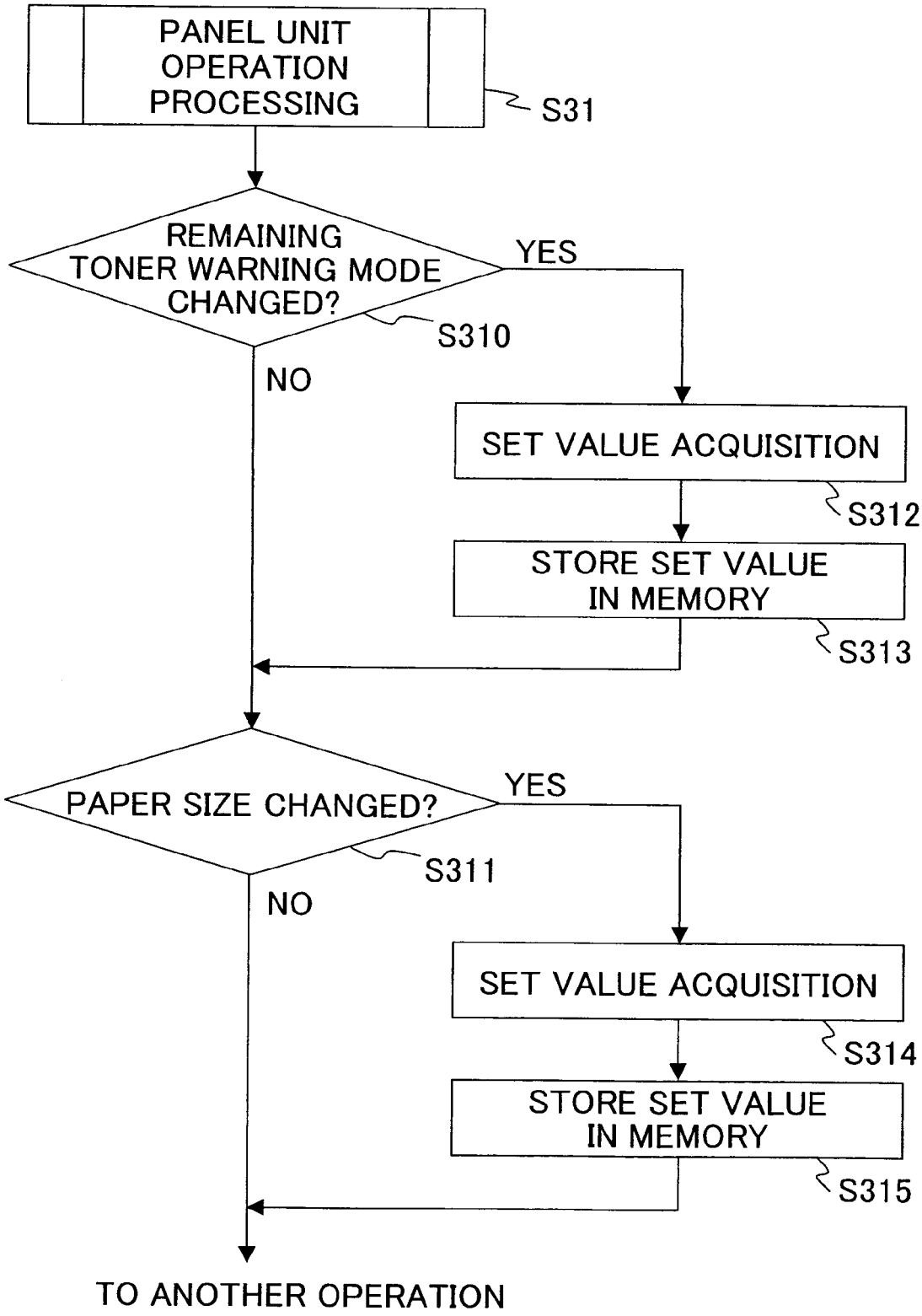
FIG. 13 is a flowchart showing the operation of the panel operation processing.

On the other hand, when the panel unit operation processing (step S31, see FIG. 5) is executed in the event processing, the processing shown in FIG. 13 is executed. That is, upon shifting to the panel unit operation processing, the CPU111 judges whether there is a change in the remaining toner warning mode (step S310). For example, the CPU111 is able to judge whether an operation for displaying a mode change screen on the operating panel 80 or host computer 200 has been performed.

When the remaining toner warning mode has been changed ("YES" in step S310), the CPU111 then acquires a set value (step S312). That is, when a change to the mode (W-Flag change) has been made by means of a suitable operation on the operating panel 80 or the monitor screen of the host computer 200, the CPU111 acquires the modified set value (value of the W_Flag). The CPU111 then stores the modified set value in the EEPROM 115 (step S313).

When a change to the remaining toner warning mode is not made ("NO" in step S310) or after the set value is stored in memory (step S313), the CPU111 then judges whether to change the paper size (step S311).

When the paper size is changed ("YES" in step S311), a set value showing the modified paper size is acquired (step S314) and stored in the EEPROM 115 (step S315). Thereafter, the remaining operation processing is performed and the processing shifts to step S15 in FIG. 3. On the other hand, when the paper size has not been changed ("NO" in step S311), the remaining operation processing is performed and the processing similarly shifts to step S15 in FIG. 3.

When the power supply of the printer 10 is then turned off ("YES" in step S15), the series of processes ends (step S16) and, when the power supply is not turned off ("NO" in step S15), the processing shifts once again to step S13 and the above processing is repeated.

As described hereinabove, according to the present invention, because either batch management mode or individual management mode is selected beforehand by means of the W_Flag, the selection can be made when an error or warning report is not issued when all the toner has not run out or similar and when only one toner has run out or similar. In addition, printing can be executed continuously because a warning or error is not reported when toner has run out or is about to run out when batch management mode is implemented. In addition, because a cartridge that is the subject of a warning or error can be specified by means of a cartridge number or the like in individual management mode, the exchange period can be grasped and management is straightforward.

Although the printer 10 was described by way of example in the above example, similar results are also yielded in the case of a facsimile or photocopier and a photocopier with these functions that includes a printer. Moreover, examples of the host computer 200 include a portable information terminal such as a personal computer and a cellular phone or PDA (Personal Digital Assistance), for example.

What is claimed is:

1. An image forming apparatus, comprising:

a mounting unit which mounts a plurality of development units holding toner of the same color; and a control unit which renders an error display or error output when the toner of all the development units has run out in a case of a batch management mode, and renders the error display or error output when the toner of any one of the development units has run out in a case of an individual management mode.

2. The image forming apparatus according to claim 1, wherein the control unit executes a warning display or warning output when the toner of any development unit among the development units is about to run out in the case of the individual mode.

3. The image forming apparatus according to claim 1, wherein the control unit executes a warning display or warning output when the toner of all the development units holding toner of the same color among the development units is about to run out in the case of the batch management mode.

4. A control method for an image forming apparatus in which a plurality of development units holding toner of the same color can be mounted, comprising the step of:

rendering an error display or error output when the toner of all the development units has run out in a case of a batch management mode; and rendering the error display or error output when the toner of any one of the development units has run out in a case of an individual mode.

* * * * *